United States Patent [19]

Drake

[11] 3,991,971

[45] Nov. 16, 1976

[54] SHUT-OFF MECHANISM FOR THE VENT PASSAGE OF A CASTING MOLD

[75] Inventor: Johannes Drake, Elsen, Germany

[73] Assignee: Gebrueder Buehler AG, Switzerland

[22] Filed: July 21, 1975

[21] Appl. No.: 597,352

[30] Foreign Application Priority Data

July 23, 1974 Germany ..... 2435272

[52] U.S. Cl. ..... 249/141; 164/410; 425/810

[51] Int. Cl.[2] ..... B29C 1/14

[58] Field of Search ..... 425/812; 249/141, 127, 249/129, 142, 144, 147, 163; 164/410

[56] References Cited

UNITED STATES PATENTS

| | | | |
|---|---|---|---|
| 2,865,052 | 12/1958 | Wilcox | 249/141 |
| 2,976,571 | 3/1961 | Moslo | 425/812 |
| 3,266,099 | 7/1966 | Bucy | 249/141 |

*Primary Examiner*—Francis S. Husar
*Assistant Examiner*—R. J. Charvat
*Attorney, Agent, or Firm*—McGlew and Tuttle

[57] ABSTRACT

A device for regulating the flow of moldable material from a mold which has two mold parts which are separable along a parting plane or surface with a vent passage defined along the plane which extends from the interior of the mold to atmosphere or to a venting apparatus such as a venting pump. One of the mold parts is provided with a recess adjacent the mold separating plane which includes a block having a vent continuation passage which communicates with the vent passage. The vent continuation passage includes a first elongated vent continuation passage portion which communicates with the lower end of a piston bore for a regulating piston which is displaceable in the bore against biasing means by an outflow of the moldable material. In addition the vent continuation passage includes a second vent continuation passage portion which extends between the first vent continuation passage portion and it communicates at one end of a transverse valve bore defined through the piston when the piston is in an initial position in which no moldable material enters into the first vent continuation passage portion. The other end of the piston transverse valve bore continues up through the block to an outer vent passage. The second vent continuation passage may comprise one or two passage portions as well as additional mold material flow areas to increase the area in which the moldable material may flow. Upon the entrance of moldable material to the base of the piston it is displaced so as to close the valve bore in the piston by displacing it from communicaton between the second vent continuation passage and the outer vent passage.

7 Claims, 2 Drawing Figures

SHUT-OFF MECHANISM FOR THE VENT PASSAGE OF A CASTING MOLD

BACKGROUND OF THE INVENTION

1. Field of the Invention

This invention relates in general to the construction of molds and in particular to a new and useful device for regulating the flow of moldable material from a vent passage of a mold.

2. Description of the Prior Art

The present invention relates particularly to shut-off mechanism for closing a vent passage of a casting mold as a function of the degree of filling of the mold. The closing of the vent passage is intended as a precaution for preventing the liquid casting material from entering into the vacuum producing device which aids in the venting of the mold or in order to prevent the material from escaping to the outside. During the venting in a casting mold it is important to allow for a sufficient time for venting in order to avoid inclusions of air in the cast material. This however requires a rapid closing of the vent passage and as soon as possible after the cast material has penetrated therein. Many solutions have been proposed for accomplishing this including a shut-off mechanism of a type which employs a control piston which acts on a lever system connected to a valve and in a system in which there are two separate parallel vent passages of which one leads to the control piston and the other to the valve. Such an arrangement the lever system is necessary because the control piston under pressure of the casting material travels only a small distance due to its disadvantageous positioning. Another drawback of such a shut-off mechanism is that the control piston is displaced only after a sufficiently high pressure builds up at its working surface. This results in a time delay which disadvantageously affects the instantaneous closing of the valve. In addition this parallel arrangement of the control piston and valve does not insure that in each case the casting material will reach first the control piston and not the valve.

In another shut-off mechanism that is known the control piston and the shut-off mechanism are mounted in series so that the casting material reaches first the control piston and only later the shut-off mechanism. In such case the control piston is positioned so tht it is actuated only after a sufficiently high pressure has been built up. In order to shorten the switching time the control piston does not switch directly the shut-off mechanism but only an additional source of energy acting on the shut-off mechanism and it operates in the particular known case on a valve designed as an amplifier and/or a converter. Such a design of the shut-off mechanism is complicated and expensive in manufacture and also due to the plurality of individual parts and numerous connections it is susceptible to very many operating difficulties.

Another known shut-off mechanism includes a control piston having a working surface on which the cast material flowing into the vent passage impinges so that the control piston is moved from its initial position into a closing position. The vent passage extends adjacent to the mold parting surface along the control piston up to a location where the vent passage is interrupted because of the displacement of the control piston. With such a construction not only the static pressure which is predominant in the cast material flow but also the kinetic energy of the material flow is utilized for actuating the control piston. This results in obtaining a longer stroke of the control piston or a shorter switching time. Additional auxiliary sources of energy controlled by the control piston and then acting on the shut-off mechanism become superfluous and with this arrangement of the control piston. The travel of the control piston is so long that it can be used for directly actuating the usual shut-off mechanism such as a valve or gate valve. However this more simple construction has not proved satisfactory.

SUMMARY OF THE INVENTION

The invention provides an improvement of the known construction and it provides a device for regulating the flow of moldable material from a mold which insures a reliable operation. The apparatus includes a control piston which is mounted in a bore which is spaced from the mold parting plane and which is advantageously located in a block which is incorporated in or formed as a part of one of the mold parts. The block includes a first elongated vent control passage portion which communicates with the piston bore defined in the block for the control piston. In the initial position the piston is located by a spring biasing means so that a cross bore defined therein aligns with a second passage communicating with the first passage. The second passage communicates with an outer vent passage through the cross bore of the control piston. When mold material begins flowing it moves into the first elongated vent continuation passage portion and acts on the piston to displace the transverse bore out of alignment with the second passage so that there will be no further flow of material after the material completely fills the second passage. The piston bore is spaced from the separating plane or parting surface of the two mold parts and it is advantageously formed in a separate block member which is insertable into a recess of one of the mold parts at the parting plane. With the inventive arrangement the material flowing through the vent passage first acts on the control piston itself and then is led through a second passage system which may for example comprise one or two separate passage portions and back to the transverse valve bore of the piston which controls the flow thereof in a further manner. The deviation of the vent passage flow away from the control piston and its subsequent return to the piston has the advantage that the cast material does not flow alongside the piston and does not increase the friction forces the piston has to overcome. In addition the detour of the cast material results in a reduction of the temperature of the control piston. It is also important that the piston bore defined in the block is provided at a location spaced away from the parting plane since the piston can be of any cross sectional shape and thus also circular. A piston of circular cross section can be matched with the bore easier and with more accuracy so that the piston slides in the bore with a minimum of play. Also the fitting of the piston in the bore does not depend on how tightly the two halves of the mold are pressed together as is the case in the prior art devices.

In accordance with another aspect of the invention it has been found advantageous to provide the shut-off member as a gate valve and to design the control piston as a cylindrical slide valve. In this case the control piston is provided with a cross bore forming a valve bore which extends obliquely or transversely to the longitudinal axis of the piston and cooperates with a second passage portion on one end of the bore and an outer vent passage portion on the other end. The second passage in turn connects to the vent passage which extends close to the mold parting plane and the outer vent passage connects to the outside atmosphere or to a vacuum producing device. Instead of a bore the control piston may also be provided with a groove for example such as an annular groove.

The kinetic energy of the flowing cast material is particularly well utilized for the actuation of the control piston if the control piston is positioned so that the cast material flowing into the first part of the vent passage impinges on the working surface of the piston in a substantially perpendicular direction. A particularly advantageous construction is a positioning of the control piston such that its longitudinal axis is relatively closely spaced from and extends parallel or at an acute angle to the parting plane of the mold. With such a design a funnel can be provided in fron of the working surface of the control piston forming a part of the first elongated vent continuation passage portion and which part provides a favorable flow connection between the section of the vent passage extending in the parting plane of the casting mold. This means that the control piston may be made relatively short.

Accordingly it is an object of the invention to provide a device for regulating the flow of moldable material from a mold having two mold parts which are separable along a parting plane and which have an inlet passage from the interior of the mold defined along the parting plane and which includes block means associated with the mold parts and being disposed alongside the parting plane which has a vent continuation passage which includes a first elongated vent continuation passage which leads to a piston bore defined in the block at a spaced location from the parting plane and with a piston slidable therein movable against a biasing force by the escape of moldable material through the vent passage to close a transverse valve bore extending therethrough in order to shut off flow from a second passage portion in communication with the first passage and communicates with the transverse valve bore on one side thereof, and with the other side of the valve bore being in communication with an outer vent passage.

A further object of the invention is to provide an device for regulating the flow of molded material through a vent passage in a mold which is simple in design, rugged in construction and economical to manufacture.

For an understanding of the principles of the invention, reference is made to the following description of a typical embodiment thereof as illustrated in the accompanying drawings.

GENERAL DESCRIPTION OF THE PREFERRED EMBODIMENT

Figure 1:
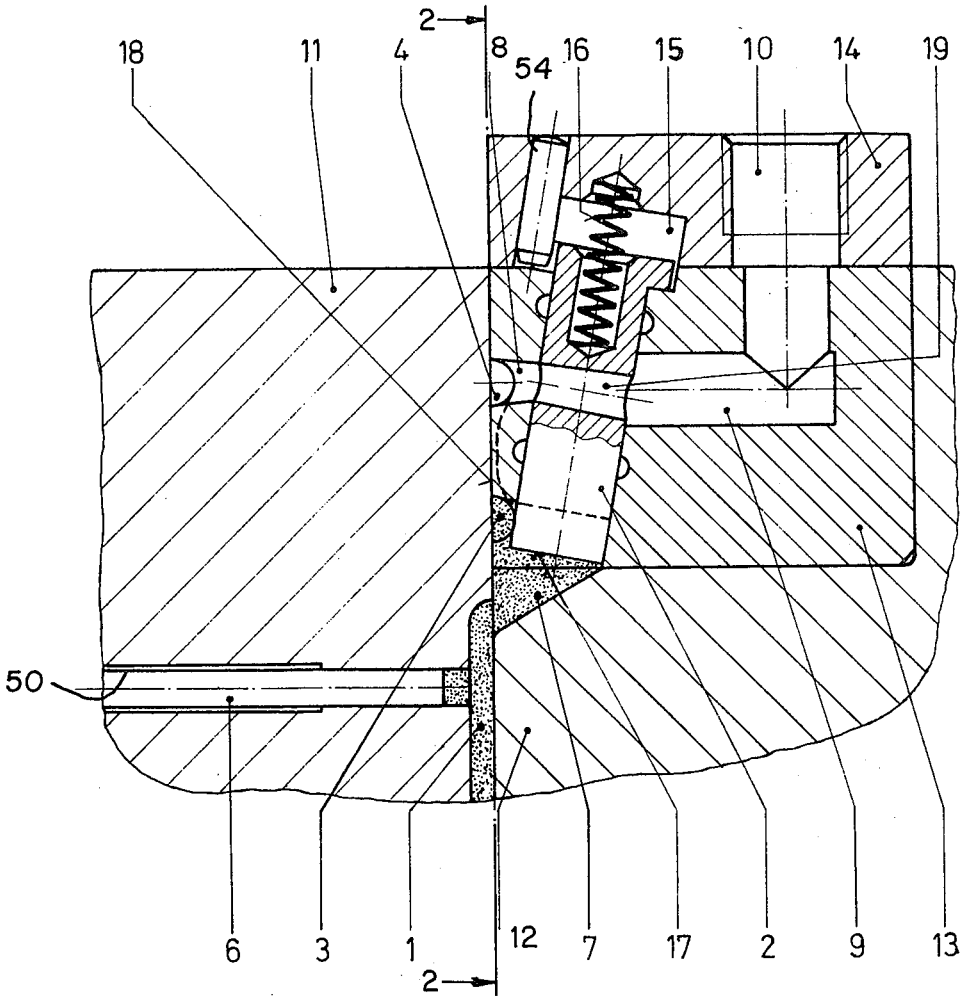
FIG. 1 is a central sectional view of a shut-off mechanism for a casting mold constructed in accordance with the invention.

Referring to the drawings in particular the invention embodied therein comprises a device for regulating the flow of moldable material from a casting mold which has two mold parts or halves 11 and 12 which are separable along a parting plane or surface formed by the end surface of the mold 12 and block means 13 which are associated therewith and are advantageously located along the parting plane. The block means 13 includes a cover part 14. The mold half 11 has a portion deffining a recess for a vent passage 1 along its edge at the parting plane 18 and also is provided with a bore portion 50 in which an axially actuable ejector pin 6 is provided for assisting the ejection of the casting after opening of the casting mold.

In accordance with the invention the vent passage 1 communicates with a vent continuation passage formed by the block means 13 and in this instance by a portion of the mold half 12. The vent continuation passage includes a funnel shaped portion 7 which communicates with a bore in the block means 13 for a control piston 2 which is slidable therein and which is biased downwardly by a spring 16 in the direction toward the parting plane in the vent passage 1. The bore for the piston 2 is located within the block means 13 so that it is spaced away from the parting plane 18.

Figure 2:
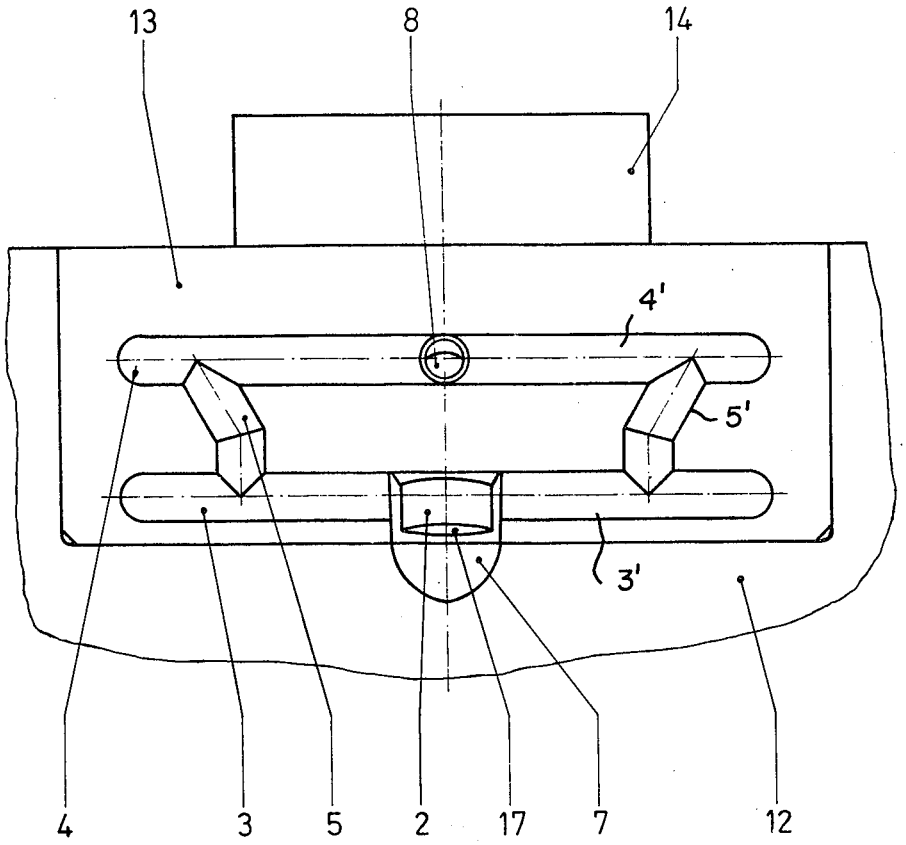
FIG. 2 is a partial side elevational view taken along line 2—2 of one of the casting mold parts having the shut-off mechanism.

As best seen in FIG. 2 the first vent control passage portion 7 includes laterally extending parts 3 and 3' which communicate with a second vent control passage portion which may advantageously include separate sections 5 and 5' leading through sections 4 and 4' to a transverse vent portion 8 on one side of a valve bore 19 defined through the piston 2.

In the position indicated in FIG. 1 the valve bore 19 is aligned with the passage 8 on its one side and an outer vent passage 9 which leads upwardly through a fitting 10 for example to a connection to a means for evacuating the vent such as a vacuum pump.

Thus the shut-off mechanism including the movable control piston 2 prevents the material from moving through the outer vent passage 9 and the connection 10 to the evacuation device. The cast material indicated by the stippled areas penetrates through the vent passage 1 defined along the parting plane and into the funnel shaped cavity 7 comprising a portion of the first elongated vent control passage. At this location the material impinges on the working surface 17 of the control piston 2 and consequently the control piston is displaced in a direction against the action of the compression spring 16. Since the control piston is designed as a gate valve with the valve bore 19 acting to close off the further connecting passages to the outer passage 9 a very rapid and effective control of the shut-off of the material flow is effected after the piston is displaced to move the valve bore 19 out of alignment with the portion 8 on one side and the passage 9 on the other side.

The cast material which flows past the working surface 18 of the control piston during the displacement of this piston also passes into the sections 3 and 3' and from there through sections 5 and 5' to the sections 4 and 4' and into the passage 8. While the material passes from sections 3 and 3' to sections 4 and 4' the flow of the cast material is repeatedly deviated and thereby delayed. Also the outer end portions of the sections 3 and 3' and 4 and 4' of the continuation vent second passage form collecting areas for the small metal particles advancing in front of the flowing material. When the flow of the cast material reaches up to the portion of the second passage at the location 8 this section must be shut off by the control piston 2 which forms a gate valve. To meet this requirement with as great a security as possible the portion of the second passage which extends from the first portion 7 to the portion 8 must be made as long as possible or provided with baffles.

In accordance with another aspect of the invention block means 13 may comprise a separately formed block which is machined so as to form a recess 16 which accommodates one end of the piston 2 and the biasing spring 16. The piston 2 is secured against turning by a pin 54. The block 13 is secured to the mold part 12. The depth of the recess 15 determines the stroke of the piston 2. In some instances it is preferable to form the mold part 2 with the block means 13.

While a specific embodiment of the invention has been shown and described in detail to illustrate the application of the principles of the invention, it will be understood that the invention may be embodied otherwise without departing from such principles.

I claim

1. A device for regulating the flow of moldable material from a mold which has two mold which are separable along a parting plane and with a vent passage which extends from the interior of the mold defined between the parts adjacent the separating plane of the parts, comprising block means associated with said mold parts and being disposed alongside the parting plane and having a vent continuation passage including a first vent continuation passage portion, a piston bore defined in said block means at a spaced location from the parting plane having a first end in communication with said first vent continuation passage portion, a piston slidable in said piston bore and having a transverse valve opening therein, biasing means biasing said piston toward said first vent continuation passage portion, said piston being displaceable against said biasing means by the flow of moldable material through the vent passage and said first vent continuation passage portion, a second vent continuation passage portion extending between said first vent continuation passage portion and said piston valve opening, and a third vent continuation passage extending outwardly from said piston valve bore on the opposite side thereof from said second vent continuation passage portion.

2. A device according to claim 1, wherein said piston is positioned so that its working face contacting the mold material extends substantially perpendicular to the flow direction.

3. A device according to claim 1, wherein the longitudinal axis of said piston is disposed at a spacing away from the parting plane.

4. A device according to claim 3, wherein the axis of said piston is disposed at an angle to the parting plane.

5. A device according to claim 1, wherein said second vent continuation passage includes flow restricting means.

6. A device according to claim 5, wherein said flow restricting means comprises at least one horizontal passage portion, at least one vertical passage portion connecting the horizontal passage portion intermediate its length so as to leave a blind passage portion.

7. A device according to claim 1, wherein said second passage portion includes a laterally extending portion on each side of the first vent continuation passage portion, a vertically extending passage portion extending upwardly from said horizontal portion on each side thereof and a second horizontal portion extending to one side of said piston.

* * * * *